US011623337B2

(12) United States Patent
Xu et al.

(10) Patent No.: US 11,623,337 B2
(45) Date of Patent: Apr. 11, 2023

(54) POWER TOOL

(71) Applicant: Nanjing Chervon Industry Co., Ltd., Nanjing (CN)

(72) Inventors: Rui Xu, Nanjing (CN); Fengshan Zhang, Nanjing (CN); Xiaoyong Wang, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 0 days.

(21) Appl. No.: 17/738,149

(22) Filed: May 6, 2022

(65) Prior Publication Data

US 2022/0388141 A1 Dec. 8, 2022

(30) Foreign Application Priority Data

Jun. 4, 2021 (CN) ..... 202110627049.X
Jun. 4, 2021 (CN) ..... 202121244240.8

(51) Int. Cl.
*B25F 5/02* (2006.01)
*B25B 23/18* (2006.01)
*F21V 33/00* (2006.01)

(52) U.S. Cl.
CPC ..... *B25F 5/02* (2013.01); *B25B 23/18* (2013.01); *F21V 33/0084* (2013.01)

(58) Field of Classification Search
CPC ..... B25F 5/02; B25B 23/18; F21V 33/0084
USPC ..... 362/119
See application file for complete search history.

(56) References Cited

U.S. PATENT DOCUMENTS

2008/0074865 A1* 3/2008 Lutz ..... B25B 23/18 362/119
2013/0286635 A1* 10/2013 Dixon ..... B25F 5/021 362/119
2018/0126538 A1* 5/2018 Qiu ..... G02B 6/0021
2021/0222866 A1* 7/2021 Niwa ..... F21V 33/008

FOREIGN PATENT DOCUMENTS

CN 211853890 U * 11/2020

* cited by examiner

*Primary Examiner* — Laura K Tso
(74) *Attorney, Agent, or Firm* — Greenberg Traurig, LLP

(57) ABSTRACT

A power tool includes a housing, a motor, a power output member, a transmission assembly, and a light source device. The power output member extends substantially along an axis and is connected to an operating accessory, and the operating accessory is provided with a working portion. The light source device includes a light guide plate, a light-emitting element, and a circuit board. The light guide plate is formed with a light exit surface for emitting light and a first light incident surface and a second light incident surface for guiding light into the light guide plate. The circuit board is used for installing the light-emitting element. A maximum distance L between the first light incident surface and the second light incident surface along a left-and-right direction is greater than or equal to 0 mm and less than or equal to 7 mm.

19 Claims, 10 Drawing Sheets

POWER TOOL

This application claims the benefit under 35 U.S.C. § 119(a) of Chinese Patent Application No. CN 202121244240.8, filed on Jun. 4, 2021, and Chinese Patent Application No. CN 202110627049.X, filed on Jun. 4, 2021, which applications are incorporated herein by reference in their entirety.

BACKGROUND

A power tool often needs to operate in some dim and narrow places, so a light source device is installed at an end of the power tool, so as to facilitate the operation of a user in some dim places. However, a light source device with a complicated structure is provided at an end of the power tool currently available on the market so that the end of the power tool is relatively long in a radial direction. In this manner, the user's line of sight is easily blocked when the user operates in the narrow place, causing inconvenience.

SUMMARY

The present application provides a technical solution described below. A power tool includes a housing, a motor, a power output member, a transmission assembly, and a gearbox. The motor is disposed in the housing. The power output member is configured to output power, extends substantially along an axis, and is connected to an operating accessory, the operating accessory is provided with a working portion, and the axis extends substantially along a front-and-rear direction. The transmission assembly is configured to transmit power of the motor to the power output member. The gearbox is configured to accommodate the transmission assembly. The power tool further includes a light source device disposed in the housing to illuminate the working portion of the power tool. The light source device includes a light guide plate, a light-emitting element, and a circuit board. The light guide plate is formed with a light exit surface for emitting light and a first light incident surface and a second light incident surface for guiding light into the light guide plate. The light-emitting element emits the light toward the light incident surface. The circuit board is used for installing the light-emitting element. A maximum distance L between the first light incident surface and the second light incident surface along a left-and-right direction is greater than or equal to 0 mm and less than or equal to 7 mm.

A power tool includes a housing, a motor, a power output member, a transmission assembly, and a gearbox. The motor is disposed in the housing. The power output member is configured to output power, extends substantially along an axis, and is connected to an operating accessory, the operating accessory is provided with a working portion, and the axis extends substantially along a front-and-rear direction. The transmission assembly is configured to transmit power of the motor to the power output member. The gearbox is configured to accommodate the transmission assembly. The power tool further includes a light source device disposed in the housing to illuminate the working portion of the power tool. The light source device includes a light guide plate, a circuit board, and a light-emitting element. The light guide plate is formed with a light exit surface for emitting light and a first light incident surface and a second light incident surface for guiding light into the light guide plate. The circuit board is fixedly installed to the light guide plate and has a first mounting surface and a second mounting surface that are oppositely disposed in a direction along a plane where the light exit surface is located. The light-emitting element is installed on each of the first mounting surface and the second mounting surface and configured to emit the light toward the light incident surface. A maximum distance L between the first light incident surface and the second light incident surface along a left-and-right direction is greater than or equal to 0.7 mm and less than or equal to 7 mm.

A power tool includes a housing, a motor, a power output member, a transmission assembly, and a gearbox. The motor is disposed in the housing. The power output member extends substantially along an axis and is connected to an operating accessory, and the operating accessory is provided with a working portion. The transmission assembly is configured to transmit power of the motor to the power output member. The gearbox is configured to accommodate the transmission assembly. The power tool further includes a light source device disposed on the power tool. The light source device is configured to emit light to illuminate the working portion and includes a first light incident surface, a second light incident surface, and a reflective surface. The first light incident surface and the second light incident surface are used for guiding light. The reflective surface is disposed on the power tool and reflects light emitted by the light source device toward the working portion. A maximum distance L between the first light incident surface and the second light incident surface along a left-and-right direction is greater than or equal to 0 mm and less than or equal to 7 mm.

DETAILED DESCRIPTION

The present disclosure is described hereinafter in detail in conjunction with drawings and examples.

The present disclosure provides a power tool 100. The power tool 100 may be an electric tool, such as an electric drill, an electric hammer, a screwdriver, and an electric wrench, or a pneumatic tool, which is not limited herein.

Figure 1:
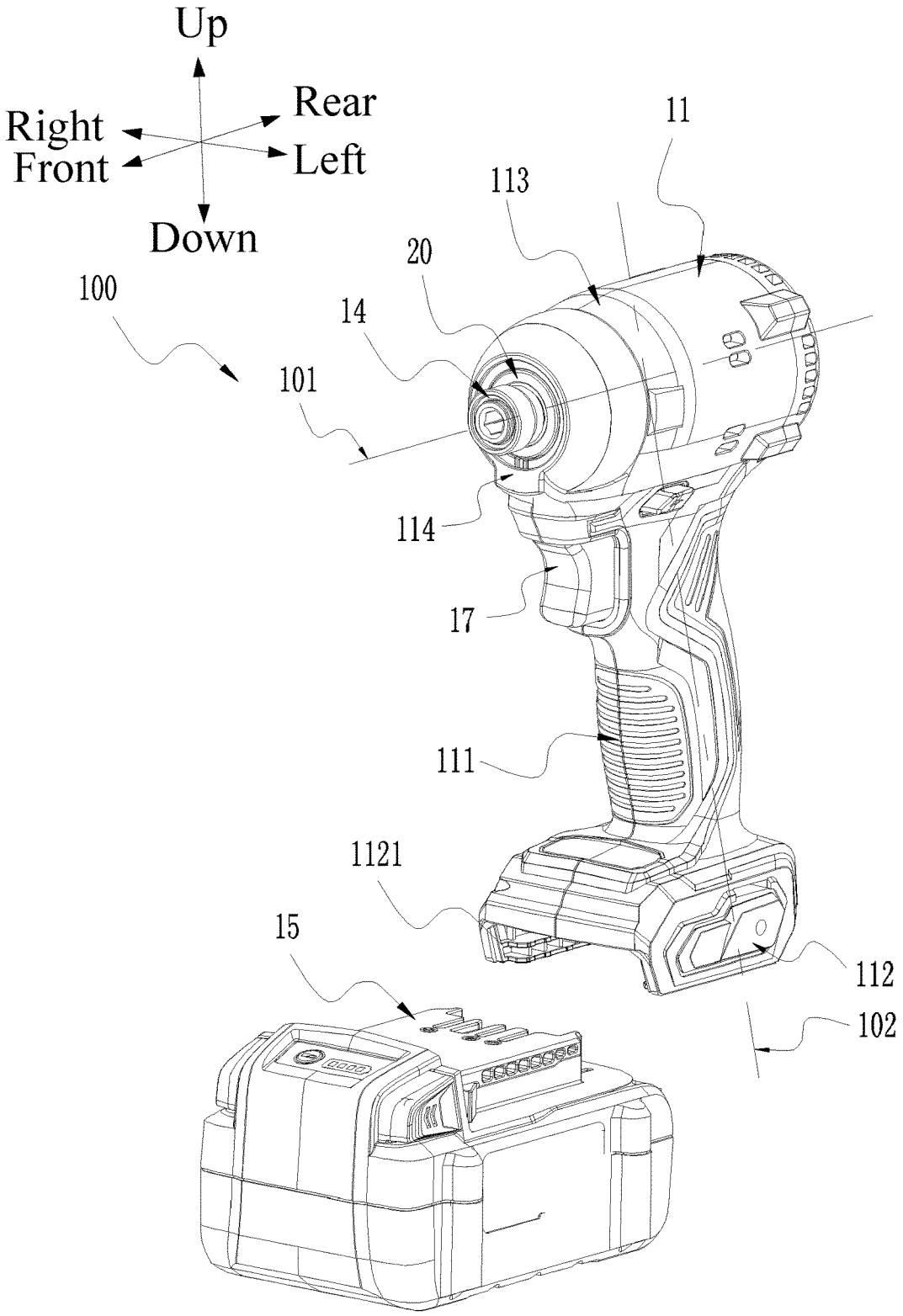
FIG. 1 is a structural view of a power tool according to the present application.

To facilitate the description of a technical solution of the present application, up, down, front, rear, left and right as shown in FIG. 1 are defined.

Figure 2:
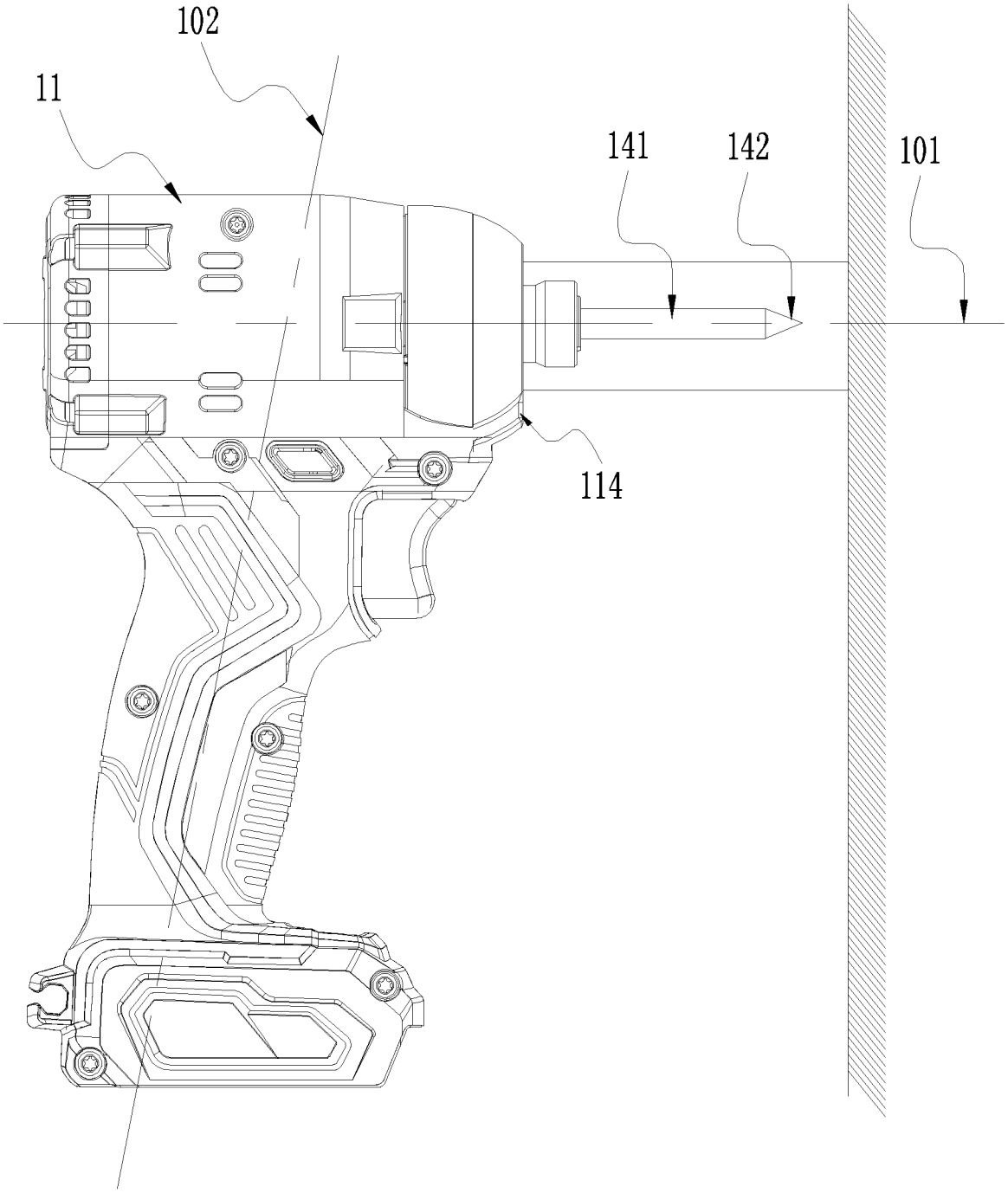
FIG. 2 is a schematic view of a working condition of a light source device in the power tool shown in FIG. 1.
Figure 3:
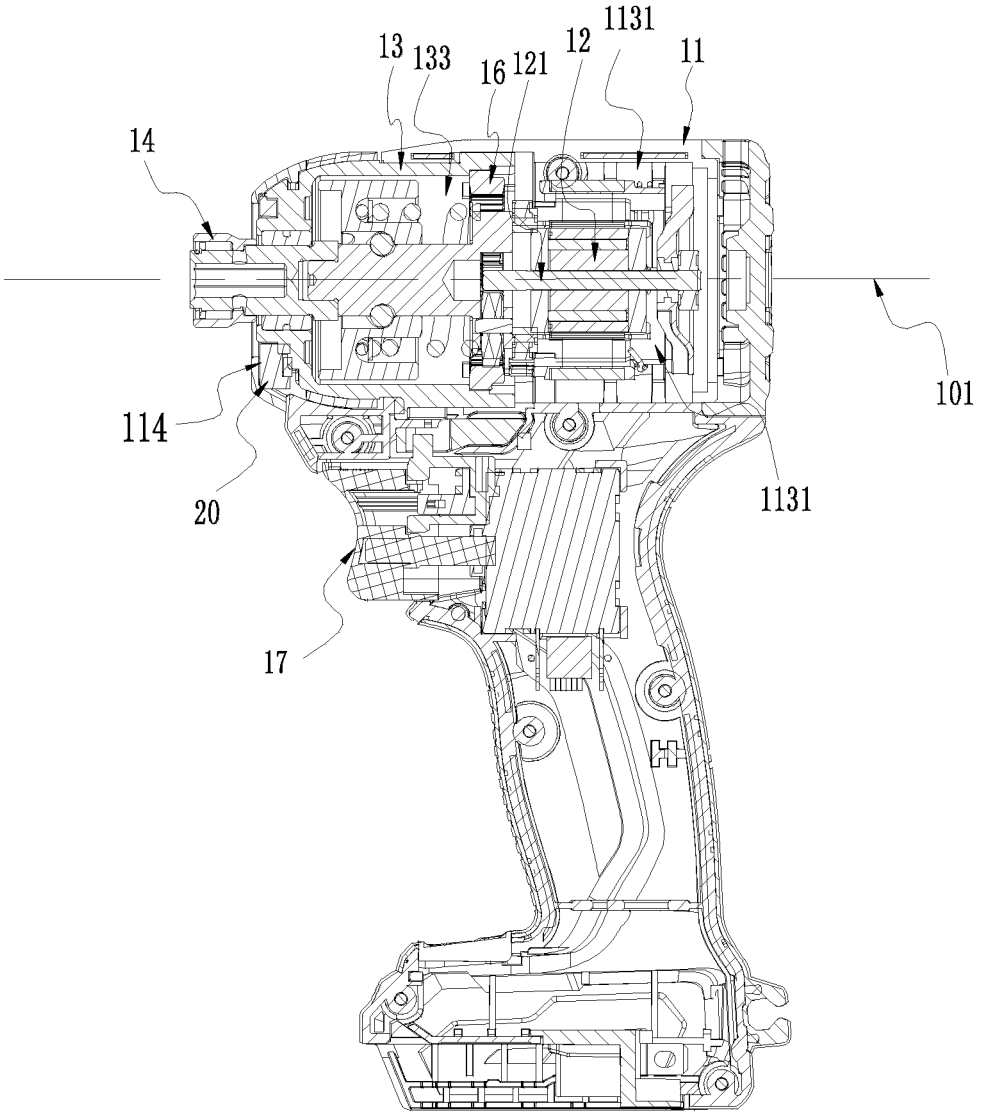
FIG. 3 is a sectional view of a power tool with a battery pack removed according to the present application.

The electric wrench is used as an example for description, but the present application is not limited to the electric wrench. As shown in FIGS. 1 to 3, the power tool 100 includes a housing 11, a switch assembly 17, a motor 12, a gearbox 13, a transmission assembly 16, a power output member 14, an energy source 15, and a light source device 20. The power output member 14 is connected to an operating accessory 141, that is, when the power tool 100 is operating, the power output member 14 can drive the operating accessory 141 to move, and the operating accessory 141 rotates so as to tighten and machine a working part. In this example, the operating accessory 141 may be a bit, a sleeve, a connecting rod, or the like.

The energy source 15 is configured to provide the power tool 100 with a power source, and the energy source 15 may use direct current or alternating current. In this example, the direct current is used, that is, the energy source 15 is specifically a battery pack. The battery pack may be plugged in or separated from the housing 11, that is, the battery pack is not directly installed on a surface of the housing 11, and a specific installation manner is not limited here, as long as the battery pack can supply power to the motor 12.

As an appearance of the power tool 100, the housing 11 is formed with at least a handle portion 111, a mounting portion 112, and an accommodation portion 113. The accommodation portion 113 extends substantially along a second direction 101 and is formed with an accommodation cavity 1131, and components such as the motor 12, the gearbox 13, and the transmission assembly 16 are at least partially disposed in the accommodation cavity 1131. The mounting portion 112 is disposed on a lower side of the accommodation portion 113, and a connecting seat 1121 is disposed on the mounting portion 112 and used for installing the battery pack. Specifically, the battery pack is slidably connected to the connecting seat 1121 in one direction. The handle portion 111 is used for a user to hold. In this example, the handle portion 111 connects the mounting portion 112 to the accommodation portion 113, and the handle portion 111 extends from a rear end of the accommodation portion 113. The handle portion 111 extends substantially along a first direction 102. Specifically, the first direction 102 intersects with the second direction 101, that is, extension directions of the handle portion 111 and the accommodation portion 113 are inclined at a certain angle, where an operating region 114 is formed between the extension directions of the handle portion 111 and the accommodation portion 113 and disposed within an angle between the first direction 102 and the second direction 101. It is to be understood that an angle between 0 degrees and 180 degrees can satisfy requirements of the operating region 114.

The switch assembly 17 is configured to start the motor 12 and disposed in the operating region 114. Specifically, the switch assembly 17 is installed on the handle portion 111. In this manner, when the user holds the handle portion 111, the switch assembly 17 may be triggered relatively conveniently, thereby starting the power tool 100.

The motor 12 is configured to provide the power tool 100 with a power source, and the motor 12 is disposed substantially along the second direction 101. The motor 12 includes a motor shaft 121 that can rotate around a motor axis. In this example, the motor axis is substantially parallel to the second direction 101, and the second direction 101 is substantially parallel to a front-and-rear direction, that is, the motor 12 is disposed substantially along the front-and-rear direction.

The transmission assembly 16 is configured to transmit power outputted by the motor shaft 121 to the power output member 14.

The power output member 14 is configured to output power, and the power output member 14 extends substantially along an axis 104. In this example, the axis 104 substantially coincides with the second direction 101. The power output member 14 may be connected to the operating accessory 141, so as to implement a function of the power tool 100. The operating accessory 141 is provided with a working portion 142. It is to be noted here that the working portion 142 refers to a region where the operating accessory 141 is in contact with a workpiece to be machined, as well as the operating accessory 141 excluding a part connected to the power output member 14.

The gearbox 13 is fixedly connected in the accommodation portion 113 and disposed on a front side of the motor 12 in the front-and-rear direction. The gearbox 13 includes a first gearbox 131 and a second gearbox 132. In the front-and-rear direction, the first gearbox 131 is disposed on a front side of the second gearbox 132, and the second gearbox 132 is disposed between the motor 12 and the first gearbox 131. The first gearbox 131 is formed with an accommodation space 133, and the transmission assembly 16 and the power output member 14 are at least partially disposed in the accommodation space 133, where part of the motor shaft 121 extends through the second gearbox 132 into the accommodation space 133 and mates with the transmission assembly 16, so as to transmit the power to the power output member 14.

The light source device 20 is fixedly installed on the power tool 100 to illuminate the working portion 142 of the operating accessory 141. Specifically, the light source device 20 is disposed adjacent to the power output member 14. In this manner, the user can see the working portion 142 clearly in some relatively dim working environments.

As shown in FIGS. 3 to 6, the light source device 20 includes a light guide plate 21, a light-emitting element 22, a circuit board 23, and a reflective element 24. The light guide plate 21 is formed with a light exit surface 213 for emitting light and a light incident surface for guiding light into the light guide plate 21. The light-emitting element 22 emits the light toward the light incident surface. The circuit board 23 is used for installing the light-emitting element 22. That is, it is to be understood that when the motor 12 is operating, the circuit board 23 transmits the power of the energy source 15 to the light-emitting element 22, the light-emitting element 22 emits the light toward the light incident surface of the light guide plate 21, the light incident surface guides the light to the light exit surface 213, and finally, the light is emitted from the light exit surface 213 so that the light source device 20 illuminates the working portion 142 of the operating accessory 141. The circuit board 23 extends in a plane parallel to or passing through the axis 104. A positioning groove **20*a* is formed on the light guide plate 21 and the circuit board 23 is fixedly connected to the positioning groove 20*a***.

The reflective element 24 is fixedly disposed in the power tool 100 and includes a reflective surface 241, and the reflective surface 241 is used for reflecting the light emitted by the light source device 20 toward the working portion 142 so that the light diffused by the light guide plate 21 may be reflected to the working portion 142, thereby improving an effect of the light in the working portion 142. The reflective element 24 is disposed in the power tool 100, that is, the reflective element 24 may be fixedly disposed on the housing 11 or in the housing 11. In this example, the reflective element 24 is fixedly connected to or integrally formed with the gearbox 13. It is to be noted that the fixed connection between the reflective element 24 and the gearbox 13 means that the reflective element 24 and the gearbox 13 are relatively fixed, but the reflective element 24 and the gearbox 13 are not made of the same material. Specifically, the reflective element 24 and the gearbox 13 may be fixed by means of adsorption, painting, electroplating, or the like. Further, the reflective element 24 may be made of paint, coating or other materials, and the specific material of the reflective element 24 is not limited here, as long as the reflective surface 241 can reflect light to the working portion 142. As another preferred example, the gearbox 13 is integrally formed with the reflective element 24, that is, the gearbox 13 is formed with the reflective element 24, that is to say, the reflective surface 241 is formed by the gearbox 13 so that the structure is simple and easy to implement.

Figure 14:
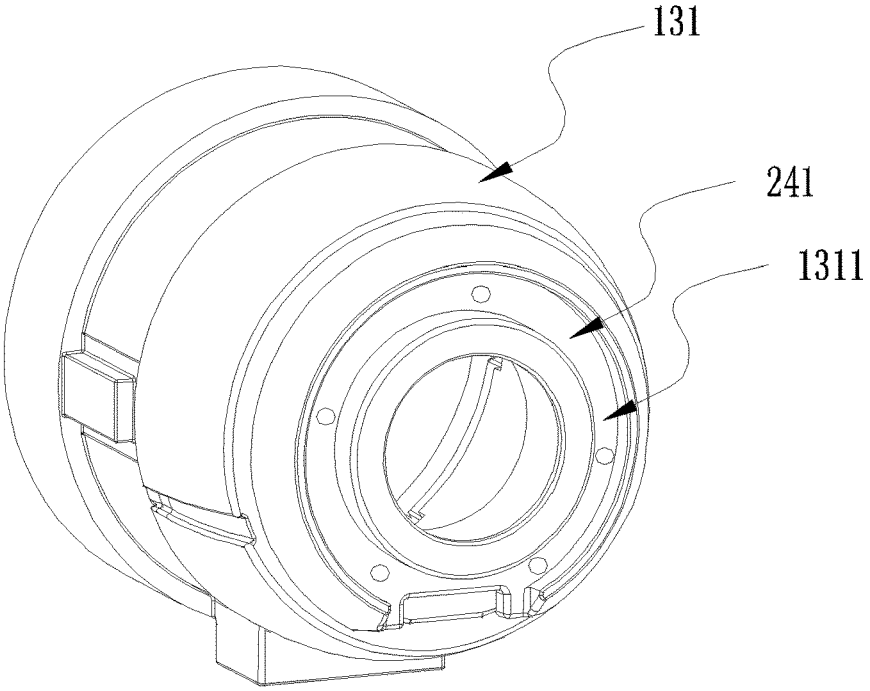
FIG. 14 is a schematic view of another arrangement of light-emitting elements according to the present application.

In this example, the gearbox 13 is formed with a mounting groove 1311, and the light source device 20 is at least partially disposed in the mounting groove 1311. Specifically, the first gearbox 131 is formed with the mounting groove 1311 recessed away from the working portion 142 near the working portion 142, and the light guide plate 21 is at least partially installed in the mounting groove 1311. The reflective element 24 is integrally formed with the gearbox 13, and the reflective surface 241 is formed by a groove wall and a groove bottom of the mounting groove 1311. In this manner, the mounting groove 1311 can not only position the light guide plate 21 but also reflect the light diffused by the light guide plate 21 to the working portion 142, thereby improving the brightness in the working portion 142. Further, roughness of the groove wall and the groove bottom of the mounting groove 1311 is less than Ra1.6 so that the reflective surface 241 on the first gearbox 131 may produce a mirror effect, thereby improving the number of refractions of light and increasing the brightness. As another feasible example, as shown in FIG. 14, multiple light-emitting elements may also be installed in the mounting groove 1311, and the light-emitting elements are annularly distributed in the mounting groove 1311 so that the light emitted by the light-emitting elements directly irradiates the working portion 142, and part of the diffused light is reflected to the working portion 142 through the reflective surface 241, thereby improving the brightness of the light in the working portion 142. In this manner, when the user is in some regions with insufficient light, the light source device may supplement the light, which can effectively solve the problem of insufficient light in a region to be machined by the user and improve the working efficiency of the user.

The circuit board 23 is disposed at an end of the light guide plate 21 in an extension direction of the light guide plate 21, the circuit board 23 is detachably and fixedly connected to the light guide plate 21, and the circuit board 23 is clamped to the light guide plate 21. Specifically, the circuit board 23 is disposed at least partially around a circumferential direction of the light guide plate 21. That is to say, the circuit board 23 may be disposed at any position along the circumferential direction around the axis 104.

The light guide plate 21 extends substantially along a track, and the light-emitting element is disposed in the circumferential direction of the light guide plate 21. The light guide plate 21 has a first light incident surface and a second light incident surface in an extension direction along the track, and the light-emitting element guides the light into the light guide plate through the first light incident surface and the second light incident surface. A maximum distance L between the first light incident surface and the second light incident surface along a left-and-right direction is greater than or equal to 0 mm and less than or equal to 7 mm. The distance L between the first light incident surface and the second light incident surface is configured to be within the preceding range so that the light emitted from the light guide plate 21 to a wall surface can present a nearly complete ring shape as much as possible, thereby widening a field of view of the user and improving the operation convenience of the user. It is to be noted that a shape of the track is not limited in the present application, that is, the shape may be a circle, a C shape, a U shape, a polygon, and the like.

As a specific example, the light guide plate 21 extends along the track which is substantially C-shaped. Specifically, the track is in a circular arc shape. The light-emitting element 22 is disposed at the end of the light guide plate 21, the light guide plate 21 is formed with a first light incident surface 211 and a second light incident surface 212 along the preceding curve direction, and the light-emitting element 22 guides the light to the light guide plate 21 through the first light incident surface 211 and the second light incident surface 212. The maximum distance L between the first light incident surface 211 and the second light incident surface 212 along the left-and-right direction is greater than or equal to 0.7 mm and less than or equal to 5 mm. That is to say, the light guide plate 21 is approximately in a ring shape around the power output member 14 so that the light emitted from the light exit surface 213 is approximately in the ring shape, which can eliminate an effect of the power output member 14 or other workpieces on the working portion 142 and makes it more convenient for the user to observe the working portion 142.

A length of the light guide plate 21 in the left-and-right direction is less than a length of the gearbox 13 in the left-and-right direction, that is to say, the light guide plate 21 is substantially embedded in the gearbox 13, so that the light emitted from the light exit surface 213 may be as close to the working portion 142 as possible, thereby ensuring a lighting effect of the working portion 142. In addition, a space of the gearbox 13 in the front-and-rear direction is also reasonably utilized, and a dimension in a length direction is shortened while the gearbox 13 is shortened in the axis 104 so that a structure of the power tool 100 is more compact.

Figure 4:
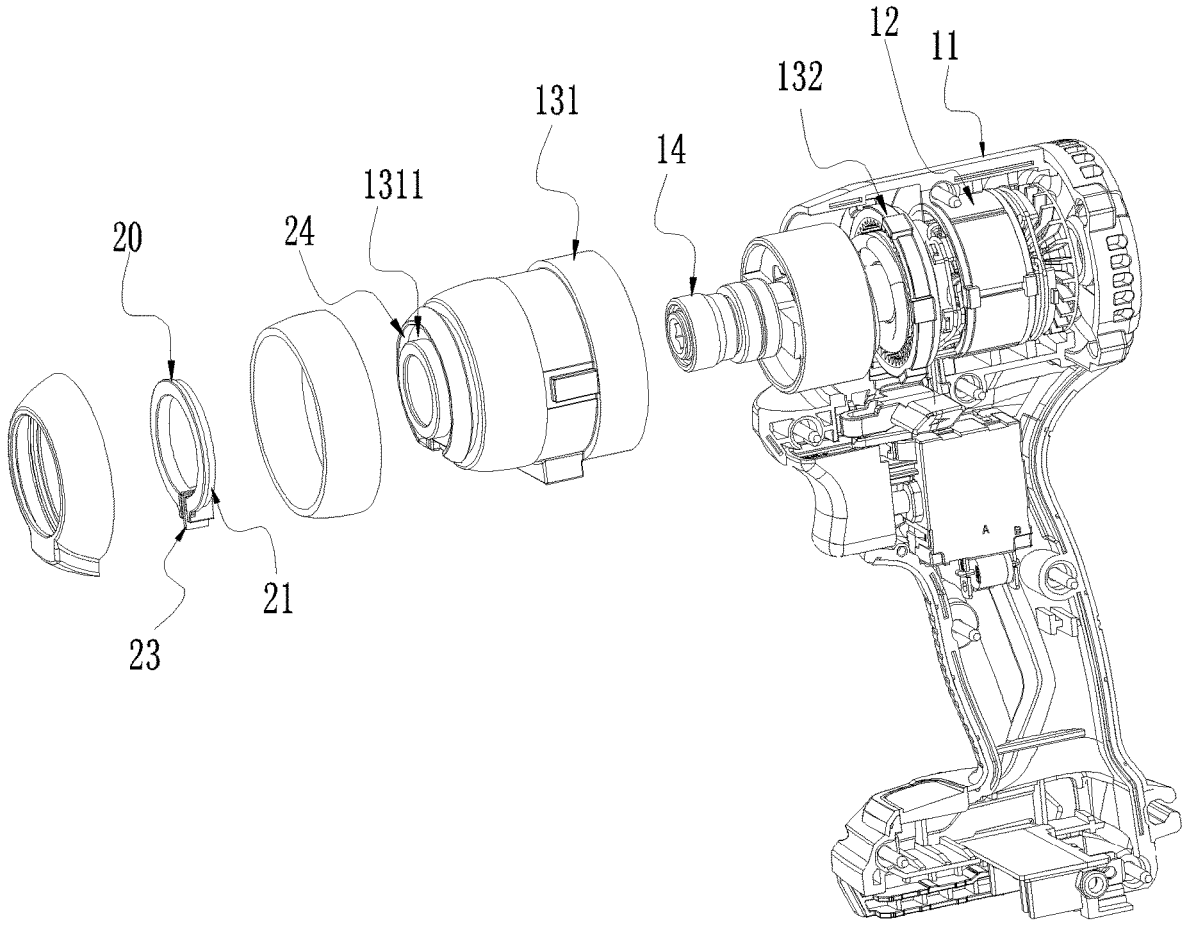
FIG. 4 is an exploded view of a power tool with a battery pack removed according to the present application.
Figure 5:
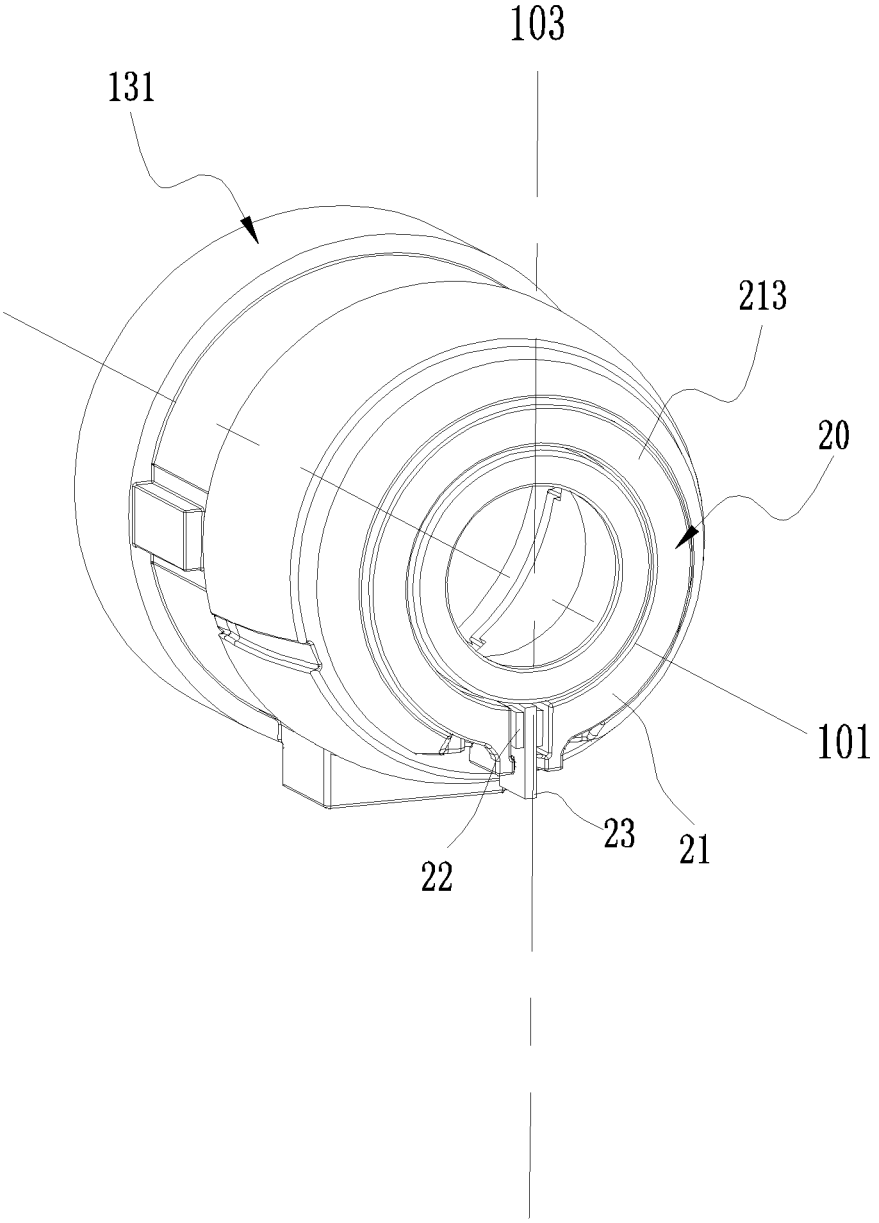
FIG. 5 is a structural view of an assembly of a gearbox and a light source device according to the present application.
Figure 6:
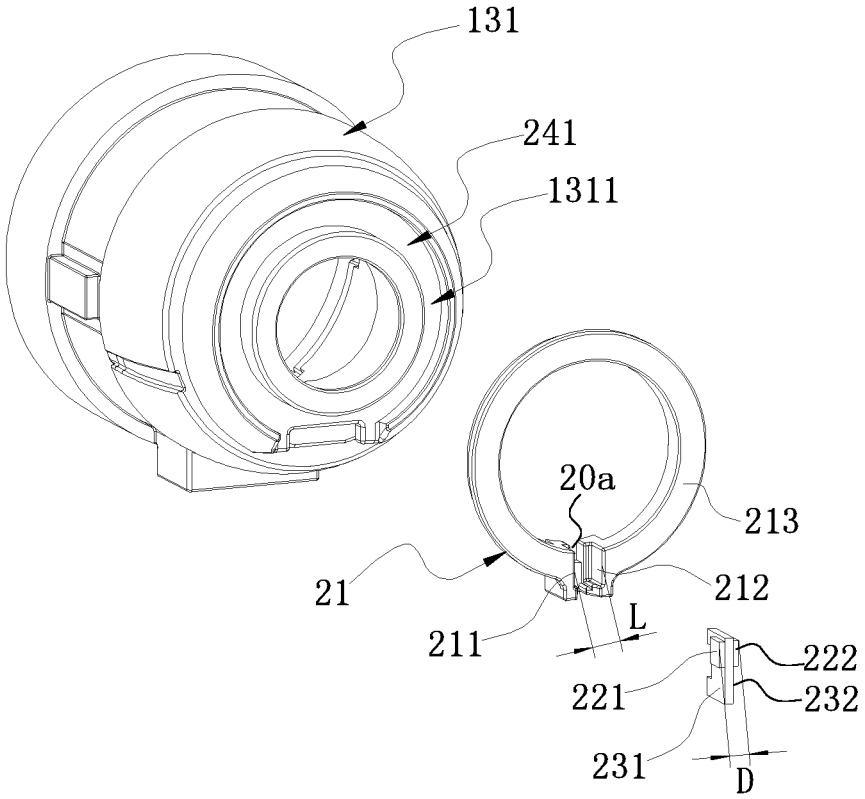
FIG. 6 is an exploded view of the structure shown in FIG. 5.

The circuit board 23 extends substantially along a first straight line 103, and an extension direction of the circuit board 23 at least partially intersects with a track direction of the light guide plate 21, that is to say, the extension direction of the circuit board 23 intersects with the axis 104. Preferably, as shown in FIGS. 4 and 5, the circuit board 23 is located in the operating region 114, that is, in an up-and-down direction, the circuit board 23 is located at a bottom end of the light guide plate 21, that is to say, the light-emitting element 22 is disposed on a lower side of the light guide plate 21, and the light-emitting element 22 is disposed between the first light incident surface 211 and the second light incident surface 212 in the left-and-right direction. Specifically, the first straight line 103 of the circuit board 23 is substantially perpendicular to the axis 104 of the power output member 14. In this example, the first straight line 103 is substantially parallel to the up-and-down direction. In the left-and-right direction, the circuit board 23 includes a first mounting surface 231 and a second mounting surface 232 that are oppositely disposed, the first mounting surface 231 is the front side of the circuit board 23, the second mounting surface 232 is the reverse side of the circuit board 23, the front side faces the first light incident surface 211, the reverse side faces the second light incident surface 212, and the light-emitting element 22 is fixedly installed on each of the first mounting surface 231 and the second mounting surface 232, that is, a first light-emitting element 221 is installed on the first mounting surface 231, the first light-emitting element 221 emits the light toward the first light incident surface 211, the first light incident surface 211 guides the light into the light exit surface 213, and finally, the light is emitted from the light exit surface 213. At the same time, a second light-emitting element 222 is installed on the second mounting surface 232, the second light-emitting element 222 emits the light toward the second light incident surface 212, the second light incident surface 212 guides the light into the light exit surface 213, and finally, the light is emitted from the light exit surface 213. In this example, a distance D between the first light-emitting element 221 and the second light-emitting element 222 along a direction perpendicular to the first straight line 103 is greater than or equal to 0.5 mm and less than or equal to 7 mm. The distance D between the first light-emitting element 221 and the second light-emitting element 222 is configured to be within the preceding range so that the light emitted from the light guide plate 21 may be approximately in the ring shape on a plane perpendicular to the light exit surface 213, thereby widening the field of view of the user and improving the operation convenience of the user. Further, the distance D between the first light-emitting element 221 and the second light-emitting element 222 along the direction perpendicular to the first straight line 103 is greater than or equal to 0.8 mm and less than or equal to 3 mm so that a light effect at a position illuminated by the power tool is better. Specifically, the first light-emitting element 221 and the second light-emitting element 222 are LED lamps. In this manner, not only the brightness of the light emitted by the light guide plate 21 is ensured, but also the distance between the first light incident surface 211 and the second light incident surface 212 is reduced so that the light emitted by the light guide plate 21 is substantially in a complete ring shape, thereby increasing an irradiation area of the light. The light-emitting elements 221, 222 are disposed at a lower side of the power output member 14.

Figure 7:
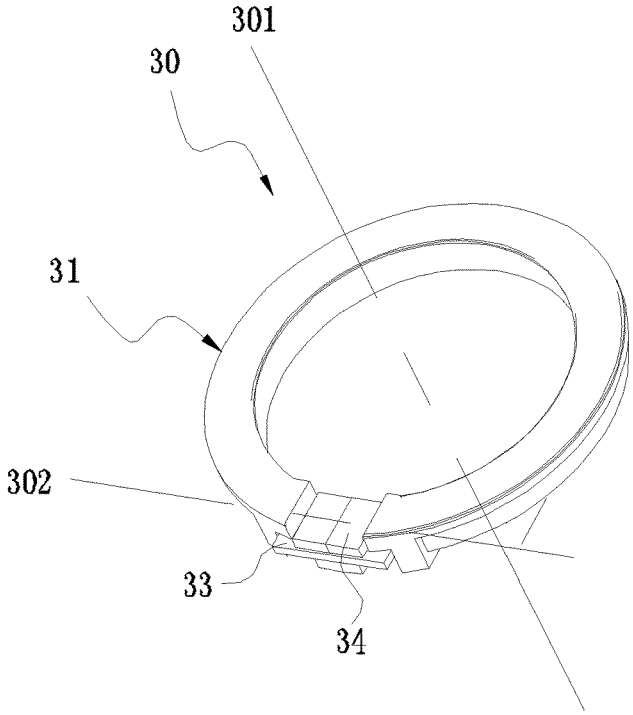
FIG. 7 is a perspective view of a light source device according to a second example of the present application.
Figure 8:
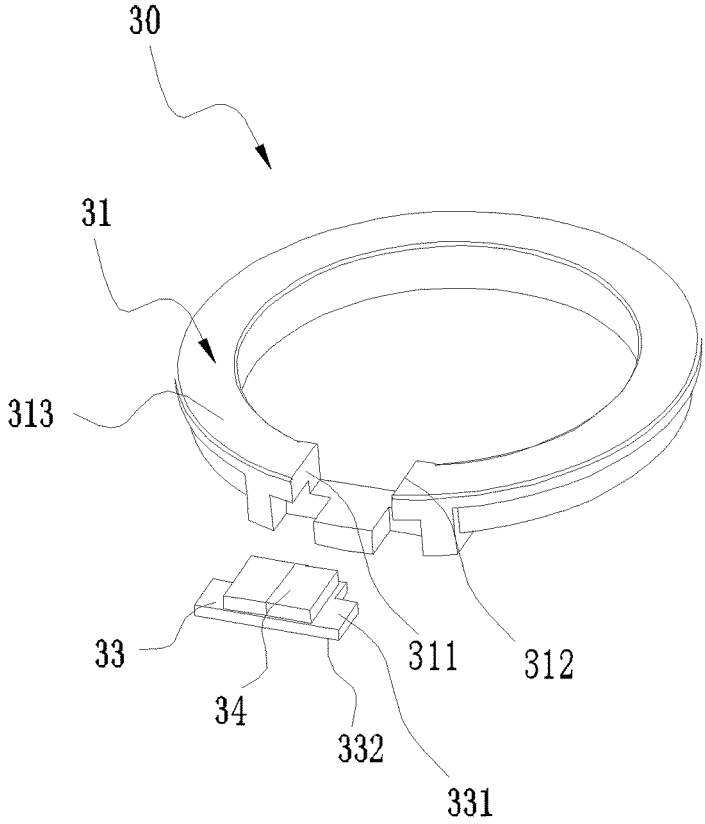
FIG. 8 is an exploded view of the light source device shown in FIG. 7 according to the present application.

FIGS. 7 and 8 are schematic views of a light source device 30 in a second example. In this example, installation positions of the motor, the transmission assembly, the gearbox, the power output member and the light source device are substantially the same as those in the first example, and a difference only lies in the specific structure of the light source device 30. The portions of the first example that are applicable to this example may be applied to this example, and merely the difference between this example and the first example is described below.

A circuit board 33 is disposed in a circumferential direction of a light guide plate 31, and the circuit board 33 is detachably and fixedly connected to the light guide plate 31. Specifically, the circuit board 33 is clamped to the light guide plate 31. The circuit board 33 extends substantially along a first straight line 302, an extension direction of the circuit board 33 is substantially perpendicular to an axis 301 of the power output member and is substantially parallel to a plane A where a light exit surface 313 is located, and the light guide plate 31 is substantially C-shaped. Preferably, as shown in FIGS. 7 and 8, the circuit board 33 is disposed in the operating region, that is, in the up-and-down direction, the circuit board 33 is disposed on a lower side of the power output member, and a light-emitting element 34 is disposed on an extension path of the light guide plate 31. Specifically, the first straight line 302 is substantially parallel to the left-and-right direction. In the front-and-rear direction, the circuit board 33 includes a first mounting surface 331 and a second mounting surface 332 that are oppositely disposed. One light-emitting element or multiple light-emitting elements 34 are installed on the first mounting surface 331, and a power cord is connected to the second mounting surface 332 for power supply to the circuit board 33 by the energy source or other energy sources. The light-emitting element 34 emits light toward a first light incident surface 311 and a second light incident surface 312, the first light incident surface 311 and the second light incident surface 312 guide the light into the light exit surface 313, and the light exit surface 313 emits the light so as to illuminate the working portion.

Figure 9:
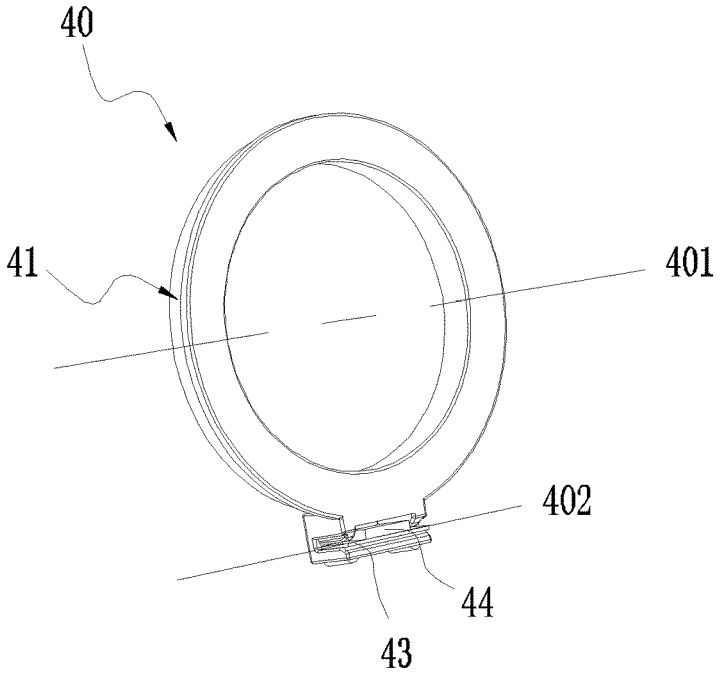
FIG. 9 is a perspective view of a light source device according to a third example of the present application.
Figure 10:
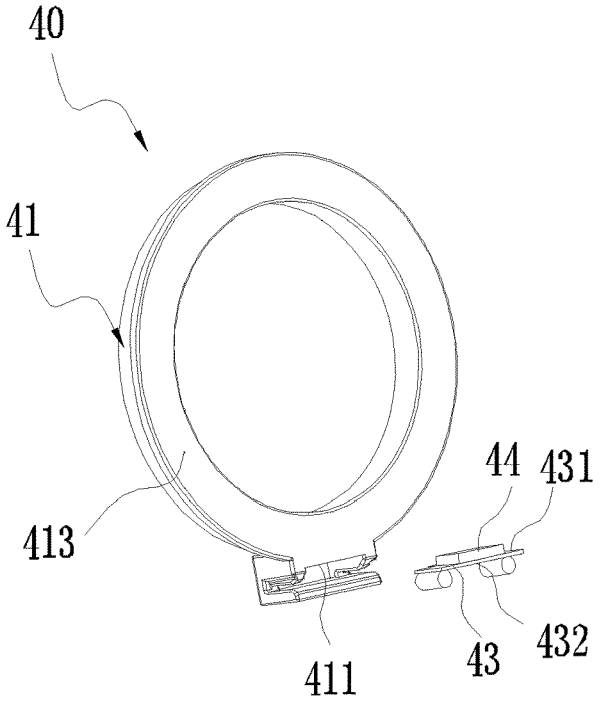
FIG. 10 is an exploded view of the light source device shown in FIG. 9 according to the present application.

FIGS. 9 and 10 are schematic views of a light source device 40 in a third example. In this example, installation positions of the motor, the transmission assembly, the gearbox, the power output member and the light source device are substantially the same as those in the first example, and a difference only lies in the specific structure of the light source device 40. The portions of the first example that are applicable to this example may be applied to this example, and merely the difference between this example and the first example is described below.

A circuit board 43 is disposed in a circumferential direction of a light guide plate 41, the circuit board 43 extends substantially along a first straight line 402, and an extension direction of the circuit board 43 is separated from a curve direction of the light guide plate 41, that is to say, the circuit board 43 is disposed on an outer circumference of the light guide plate 41. Preferably, as shown in FIGS. 9 and 10, the circuit board 43 is located in the operating region, that is, in the up-and-down direction, the circuit board 43 is located on a lower side of the light guide plate 41, that is to say, a light-emitting element 44 is disposed on the lower side of the light guide plate 41. Specifically, the circuit board 43 is detachably installed on the light guide plate 41, and the first straight line 402 of the circuit board 43 is substantially perpendicular to an axial direction 401 of the power output member. In this example, the first straight line 402 is substantially parallel to the left-and-right direction. In the up-and-down direction, the circuit board 43 includes a first mounting surface 431 and a second mounting surface 432 that are oppositely disposed. The second mounting surface 432 is farther from the power output member relative to the first mounting surface 431. At least one light-emitting element 44 is installed on the first mounting surface 431. The light-emitting element 44 emits light toward a light incident surface 441, the light incident surface 411 guides the light into a light exit surface 413, and finally, the light is emitted from the light exit surface 413 so as to illuminate the working portion. In this manner, the light guide plate 41 may be designed as a complete ring, that is, only one light incident surface 411 needs to be provided, and at the same time, only one light-emitting element 44 that emits light toward the light incident surface 411 needs to be provided for satisfying lighting requirements of the working portion. Of course, as another example, in the case where positions of the circuit board and the light-emitting element remain unchanged, two light incident surfaces may be provided at intervals, as long as the light-emitting element emits light toward the light incident surfaces.

Figure 11:
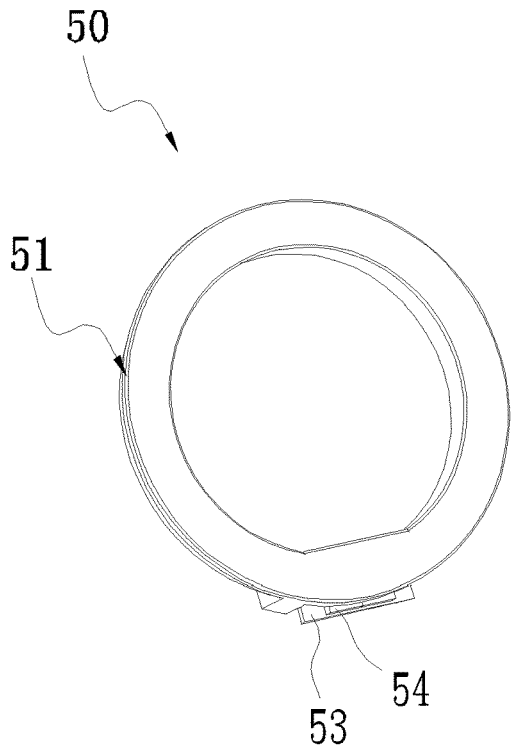
FIG. 11 is a perspective view of a light source device according to a fourth example of the present application.
Figure 13:
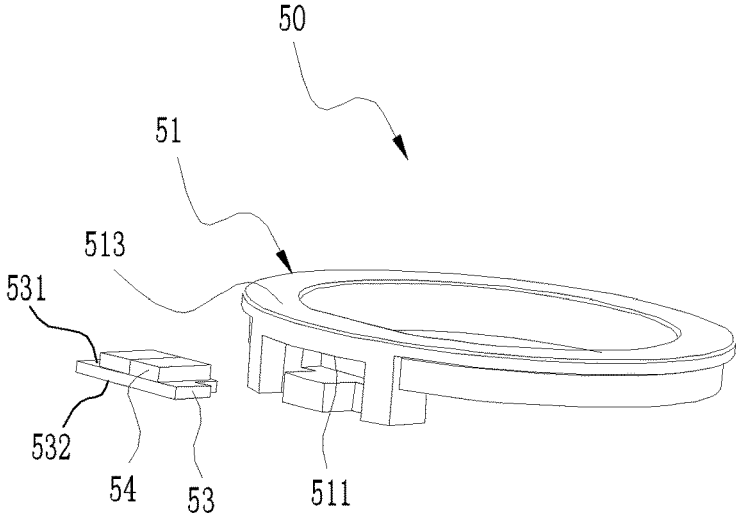
FIG. 13 is a structural view of the light source device shown in FIG. 12 from another perspective according to the present application.

FIGS. 11 and 13 are schematic views of a light source device 50 in a fourth example. In this example, installation positions of the motor, the transmission assembly, the gearbox, the power output member and the light source device are substantially the same as those in the first example, and a difference only lies in the specific structure of the light source device 50. The portions of the first example that are applicable to this example may be applied to this example, and merely the difference between this example and the first example is described below.

Figure 12:
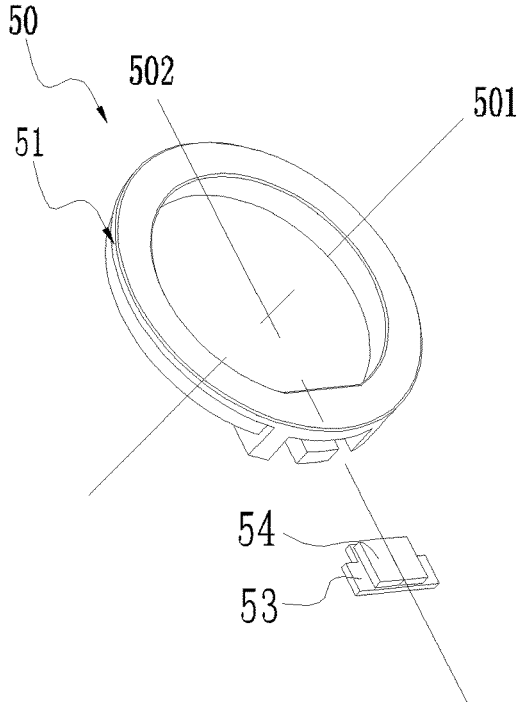
FIG. 12 is an exploded view of the light source device shown in FIG. 11 according to the present application.

A circuit board 53 is disposed in a circumferential direction of a light guide plate 51, the circuit board 53 is detachably connected to the light guide plate 51, the circuit board 53 extends along a first straight line 502, the first straight line 502 is substantially perpendicular to an axial direction 501 of the power output member, the first straight line 502 is substantially parallel to a plane where a light exit surface 513 is located, and the light guide plate 51 is substantially in a ring shape. Preferably, as shown in FIGS. 11 to 13, the circuit board 53 is disposed in the operating region, that is, in the up-and-down direction, the circuit board 53 is disposed on the lower side of the power output member. In the front-and-rear direction, the circuit board 53 includes a first mounting surface 531 and a second mounting surface 532 that are oppositely disposed. One light-emitting element or multiple light-emitting elements 54 are installed on the first mounting surface 531, and a power cord is connected to the second mounting surface 532 for power supply to the circuit board 53 by the energy source or other energy sources. The light-emitting element 54 emits light toward a light incident surface 511 of the light guide plate 51, the light incident surface 511 guides the light into the light exit surface 513, and the light exit surface 513 emits the light so as to illuminate the working portion. The light incident surface 511 is disposed on a front side of the light-emitting element 54 in the front-and-rear direction.

What is claimed is:

1. A power tool, comprising:

a housing;

a motor disposed in the housing;

a power output member configured to output power, wherein the power output member extends substantially along an axis and is connected with an operating accessory, the operating accessory is provided with a working portion, and the axis extends substantially along a front-and-rear direction;

a transmission assembly configured to transmit power of the motor to the power output member;

a gearbox for receiving the transmission assembly; and a light source device configured to illuminate the working portion of the power tool or a working are, wherein the light source device comprises:

a light guide plate formed with a light exit surface for emitting light and a first light incident surface and a second light incident surface for guiding light into the light guide plate, wherein the light guide plate surrounds the power output member;

a light-emitting element emitting the light toward the first light incident surface and the second light incident surface;

a circuit board for installing the light-emitting element; and a reflective element provided with a reflective surface that reflects light emitted by the light-emitting element toward the working portion, wherein the gearbox is integrally formed with the reflective element, and the gearbox is formed with a mounting groove, and the light source device is at least partially disposed in the mounting groove, and wherein a maximum distance L between the first light incident surface and the second light incident surface is greater than or equal to 0 mm and less than or equal to 7 mm.

2. The power tool of claim 1, wherein the maximum distance L between the first light incident surface and the second light incident surface is in the range of 0.7 mm and 5 mm.

3. The power tool of claim 1, wherein at least one light-emitting element is installed on the circuit board.

4. The power tool of claim 1, wherein the light guide plate is disposed in a circumferential direction around the axis and at least a portion of the circuit board is disposed in the circumferential direction of the light guide plate.

5. The power tool of claim 1, wherein the circuit board extends substantially along a first straight line, the first straight line is substantially perpendicular to the axis, and the first straight line is substantially perpendicular to a plane where the light exit surface is located.

6. The power tool of claim 5, wherein in a direction perpendicular to the first straight line, the circuit board comprises a first mounting surface and a second mounting surface that are oppositely disposed, and the light-emitting element is installed on each of the first mounting surface and the second mounting surface.

7. The power tool of claim 6, wherein the light-emitting element comprises a first light-emitting element and a second light-emitting element and a distance D between the first light-emitting element and the second light-emitting element along the direction perpendicular to the first straight line is greater than or equal to 0.5 mm and less than or equal to 7 mm.

8. The power tool of claim 1, wherein a positioning groove is formed on the light guide plate and the circuit board is fixedly connected to the positioning groove.

9. The power tool of claim 1, wherein the light-emitting element is installed on each of a front side and a reverse side of the circuit board.

10. The power tool of claim 1, wherein the light-emitting element comprises a first light-emitting element disposed at a front side of the circuit board and a second light-emitting element disposed at a reverse side of the circuit board and a distance D between the first light-emitting element and the second light-emitting element is greater than or equal to 0.5 mm and less than or equal to 7 mm.

11. The power tool of claim 1, the reflective surface is formed by a groove wall and a groove bottom of the mounting groove.

12. The power tool of claim 1, wherein a groove bottom of the mounting groove is provided with a reflective surface for reflecting light emitted by the light-emitting element.

13. The power tool of claim 1, wherein a roughness of the groove bottom of the mounting groove is less than Ra1.6.

14. The power tool of claim 1, wherein the circuit board comprise a front side and a reverse side opposite the front side, the front side faces the first light incident surface, the light-emitting element comprises a first light-emitting element mounted on the front side, the reverse side faces the second light incident surface, and the light-emitting element comprises a second light-emitting element mounted on the reverse side.

15. A power tool, comprising:

a housing;

a motor disposed in the housing;

a power output member configured to output power, wherein the power output member extends substantially along an axis and is connected to an operating accessory, the operating accessory is provided with a working portion;

a transmission assembly configured to transmit power of the motor to the power output member;

a gearbox for receiving the transmission assembly; and a light source device, wherein the light source device comprises:

a light guide plate formed with a light exit surface for emitting light and a first light incident surface and a second light incident surface for guiding light into the light guide plate;

a light-emitting element configured to emit the light toward the first light incident surface and the second light incident surface; and a reflective element provided with a reflective surface reflects light emitted by the light-emitting element toward the working portion, wherein the gearbox is integrally formed with the reflective element, and the gearbox is formed with a mounting groove, and the light source device is at least partially disposed in the mounting groove, and wherein a maximum distance L between the first light incident surface and the second light incident surface is in the range of 0.7 mm and 7 mm.

16. The power tool of claim 15, wherein the light source device further comprises a circuit board for mounted the light-emitting element, the circuit board extends substantially along a first straight line, the first straight line is substantially perpendicular to the axis, and the first straight line is substantially perpendicular to a plane where the light exit surface is located.

17. The power tool of claim 15, wherein the light source device further comprises a circuit board for mounted the light-emitting element and the circuit board extends in a plane parallel to or passing through the axis.

18. The power tool of claim 15, wherein the light-emitting element is disposed at a lower side of the power output member.

19. The power tool of claim 15, wherein the power tool is an electric hammer, a screwdriver, or an electric wrench.

* * * * *